United States Patent [19]

Meelhuysen

[11] Patent Number: 4,846,732

[45] Date of Patent: Jul. 11, 1989

[54] TRANSIENT SUPPRESSION CONNECTOR WITH FILTERING CAPABILITY

[75] Inventor: Edgar R. Meelhuysen, San Bernardino, Calif.

[73] Assignee: EMP Connectors, Inc., Redlands, Calif.

[21] Appl. No.: 228,719

[22] Filed: Aug. 5, 1988

[51] Int. Cl.[4] ..... H01R 13/66

[52] U.S. Cl. ..... 439/620; 333/185; 439/519

[58] Field of Search ..... 439/620, 519; 333/181–185

[56] References Cited

U.S. PATENT DOCUMENTS

| | | | |
|---|---|---|---|
| 3,961,295 | 6/1976 | Hollyday et al. | 439/620 |
| 4,572,600 | 2/1986 | Nieman | 439/620 |
| 4,582,385 | 4/1986 | Couper et al. | 439/620 |
| 4,600,262 | 7/1986 | Nieman et al. | 439/620 |
| 4,647,138 | 3/1987 | Muz | 439/620 |
| 4,729,743 | 3/1988 | Farrar et al. | 439/620 |
| 4,746,310 | 5/1988 | Morse et al. | 439/620 |

FOREIGN PATENT DOCUMENTS

| | | | |
|---|---|---|---|
| 2059182 | 4/1981 | United Kingdom | 439/620 |

*Primary Examiner*—Gary F. Paumen

[57] ABSTRACT

An electrical connector containing contacts upon which there are mounted high current transient suppressing diodes and ceramic semi-tubular filtering components. The diode and filter components are mounted on opposite sides of each contact body. A diode grounding lead provides the electrical connection between the diode and the ground plane in the connector containing openings into which the contacts are mounted.

17 Claims, 2 Drawing Sheets

TRANSIENT SUPPRESSION CONNECTOR WITH FILTERING CAPABILITY

BACKGROUND OF THE INVENTION

1. Field of the Invention

This invention relates to electrical connectors, especially as involving transient signal suppression electrical connectors and Electromagnetic interference (EMI) filtering electrical connectors.

2. Description of the Prior Art

U.S. Pat. No. 4,600,262 to Neiman et al discloses an electrical connector in which one or more electrical circuit components are mounted on the side of each contact, rather than surrounding the contact body as in prior art filter connectors, such as disclosed in U.S. Pat. No. 3,670,292 to Tracy where the filter element on each contact is of complete cylindrical form.

Present transient suppression connectors such as that disclosed in U.S. Pat. No. 4,729,743 to Farrar et al and in U.S. Pat. No. 4,746,310 to Morse et al which contain both transient suppression means as well as filtering means, perform the transient suppression and filtering functions in a serial or in-line fashion, in which the transient suppression means are mounted on the forward portion of each contact and the filter means are disposed on the rearward portion of the contact. This serial design adds to the overall length of the connector and may be unacceptably long for some end users.

Close examination of the aforementioned patents reveals that relatively small diodes are used due to the space limitations and mounting manner in which the diodes are placed. These diodes are rated at no more than 500 to 600 watts at room temperature. For a breakdown voltage rating of 10 volts, this produces a current handling ability of 50 to 60 amps, which is more than adequate for most applications. However as the breakdown voltage rating increases, the current handling ability decreases as a function of power divided by voltage. Thus for a breakdown voltage ration of 100 volts, this produces a current handling ability of only 5–6 amps. At higher temperatures, the power rating of a transient suppression diode is reduced even further. For many applications requiring survivability to lightning or other high voltage pulses such as electrical systems in composite aircraft might see or for electrical systems operating at higher temperatures, this current ration is much too low.

For additional current handling ability, prior art suggests placing transient suppression diodes in parallel between the contact and the grounding plate as suggested by Nieman et al in the previously mentioned patent in which the diodes are placed at either end of the outwardly bowed leaf spring or by Couper et al in U.S. Pat. No. 4,582,385 where the diodes may be placed on opposite sides of the contact. However, if there is even a small voltage breakdown difference between the nominally rated diodes, for a given transient, the diode with the lower breakdown voltage will begin conducting first, carrying the bulk of the transient current until its clamping voltage increases (due to an increase in its temperature from the upper dissipated) and the other diode begins conducting. Thus there exists an opportunity for the first diode to be damaged by the transient. Since most transient suppression diodes fail in the short circuit mode rather than the circuit mode, damage may occur in the very electronics that the device was intended to protect.

Transient suppressing diodes have an inherently high level of capacitance, usually between 300–2000 pF. This capacitance is acceptable and even desirable for low to medium frequency signals where high frequency filtering is required. However, for high frequency digital signals of 1 MHz and above, this level of capacitance is unacceptable, causing excessive degradation of the digital signal.

SUMMARY OF THE INVENTION

According to the principal aspect of the present invention, there is provided an electrical connector member in which a transient suppression diode is mounted on one side of a contact and a semi-tubular ceramic capacitor element is mounted on the other side in such a manner as to partially surround the contact, the diode being located within the length of the semi-tubular capacitor. Thus the filtering and transient suppression functions can be performed within the same length envelope in a parallel rather than serial fashion.

Secondly, additional current handling capability can be achieved by stacking diodes on top of one another to distribute the power among the diodes and a low capacitance design is achieved by stacking low capacitance diodes in series with the transient suppressing diode. This can be done for unipolar as well as bipolar applications.

Finally for additional strength and for an environmentally impervious seal, the midsection of the contact containing the diode and capacitor is encapsulated in a hermetic material, grounding surfaces excepted.

It is the object of the present invention to provide a transient suppression as well as EMI/RFI filtered high density, multi-contact electrical connector that is simple and compact in design.

It is also an object of this invention to provide a technique of handling high current pulses at high breakdown voltage ratings while still maintaining a high density connector.

Furthermore, it is an object of this invention to provide a technique whereby the inherently high capacitance of the transient suppressing diode may be reduced to acceptable levels for applications requiring minimal capacitance.

Further objects and advantages of the invention will become apparent from the study of the following portion of the specification, the claims and the attached drawings.

DESCRIPTION OF THE PREFERRED EMBODIMENTS

The present invention will be described herein as being incorporated in an electrical connector member in the form of a receptacle with extended pin type contacts. However, it will be understood that the invention may be incorporated in a plug half, adapter or other connector form. The mating end of the constants may be in a pin or socket configuration, with various rear terminations such as square wire wrap terminations, solder pot terminations, or having provision for crimp style contacts piggybacked onto the rear end of the diode bearing contact.

Figure 1:
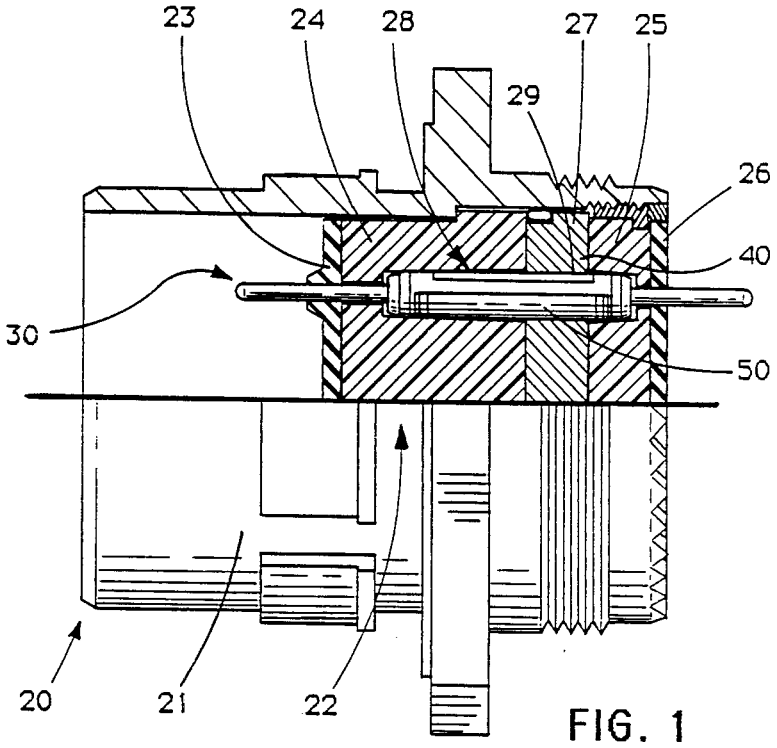
FIG. 1 is a partial longitudinal sectional view through a connector embodying the present invention.

The preferred embodiment of the receptacle of the present invention is shown in FIG. 1. The receptacle 20 comprises a metallic shell 21, the forward end of the shell adapted to engage a mating plug connector member, not shown.

The shell 21 contains an insert or insulator assembly 22 consisting of a front elastomeric seal 23, a front locating insert 24, a rear locating insert 25, and a rear seal 26. A grounding plate 27, which is maintained in electrical contact with the shell, is disposed between the front and rear locating inserts 24 and 25. A plurality of aligned openings extend through the insert 22, providing contact cavities 28. A hole 29 is formed in the grounding plate 27 coaxial with the cavity 28. A contact 30 is mounted in each contact cavity 28 and extends through the hole 29 in the grounding plate.

Figure 2:
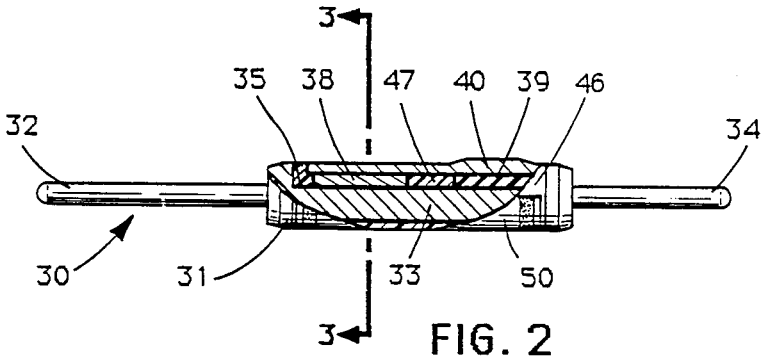
FIG. 2 is a enlarged partial sectional view of the mid-section of the contact of the present invention showing how the electrical components are mounted thereon.
Figure 3:
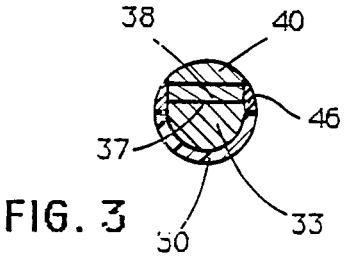
FIG. 3 is a enlarged transverse sectional view taken along line 3—3 of FIG. 2.

The contact 30, as best seen in FIGS. 2 and 3, consists of a generally cylindrical contact body 31 having a forward mating end 32, shown in the form of a pin contact, a mid-section 33 and a rear terminating end 34, which is shown in the form of an extended pin type termination.

A notch or recess 35 is formed in the mid-section 33 of the contact. The bottom of the notch forms a flat supporting surface 37 as best seen in FIG. 3. A transient suppression diode 38 is bonded towards the forward end of the notch 35 while a supporting pad 39 is placed towards the rear end of the notch. A soft metal diode grounding lead 40 is bonded onto the top surface of the transient suppression diode 38 with the other end of the grounding lead 40 extending over and laying on top of the supporting pad 39. The top surface of the diode grounding lead 40 is radiused transversely such as to engage the cylindrical configuration of the hole in the grounding plate 27 and provide for an excellent conductive joint. The supporting pad 39 is placed such as to be generally aligned with the grounding plate 27 when the contact is assembled into the connector.

A semi-tubular ceramic capacitor 50 is bonded to the mid-section 33 of the contact such that the capacitor partially surrounds the contact, and such that the longitudinal open section of the semitubular capacitor is oriented with and over laps the diode assembly. This allows the contact assembly to be greatly shortened as the transient suppression means and the filtering means are located within the same longitudinal envelope. For purposes of this invention, semi-tubular is defined as being of partial tubular form, i.e. a complete tubular part reduced by removal of some portion.

Figure 4:
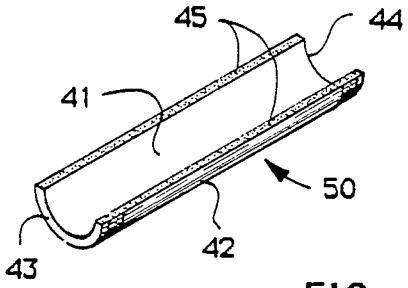
FIG. 4 is a perspective view of the semi-tubular ceramic capacitor.

As best seen in FIG. 4, the plating on the inner diameter 41 extends the full length of the capacitor, while the plating on the outer diameter 42 of the semi-tubular ceramic capacitor 50 extends near the front 43 and rear 44 edges of the capacitor. No plating bridges the inner and outer plating on the longitudinal edges 45 of the capacitor. These edges define the longitudinal sides of the longitudinal open section. Bonding of the capacitor 50 to the outer cylindrical surface of the mid-section 33 of the contact occurs over the entire inner plating 41 of the capacitor. Thus, the usually delicate ceramic is fully supported by the metallic contact, greatly reducing the opportunity for ceramic breakage, while also providing an excellent electrical bond to the contact.

After the diode 38, supporting pad 39, diode grounding lead 40 and semi-tubular ceramic capacitor 50 are assembled onto the mid-section 33 of the contact, the mid-section of the contact is encapsulated with a hermetic material 46, with the exception of the grounding surfaces of the capacitor and diode grounding lead. The hermetic material provides overall rigidity to the contact assembly, helps to reduce the stress concentration at the diode interfaces, acts as a heatsink for the diode and filter and reduces degradation of the silicon or other diode material.

In the embodiment shown in FIG. 2, the hermetic material in position 47 acts as a pivot or fulcrum point for the soft metal grounding lead 40, the lead bending over the pivot point. During vibration or shock, any stress is transmitted through the grounding 40, the supporting pad 39, the contact and in capacitor 50, the bending stress being absorbed by the material 47 and the give of the soft metal of the diode grounding lead and is not transmitted to the diode 38.

Figure 5:
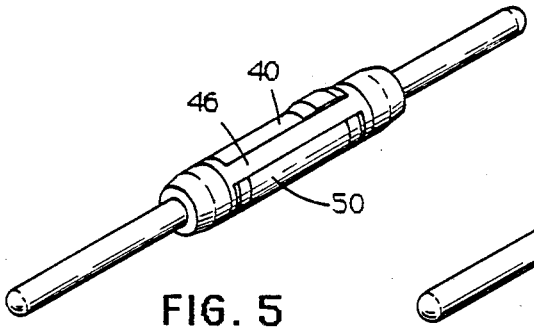
FIG. 5 is a perspective view of the contact of the present invention shown in the assembled and encapsulated condition.

Several embodiments of the diode grounding lead and supporting pad are possible. The embodiment shown in FIGS. 2 and 5 utilizes a resilient material for the supporting pad 39 (not shown in FIG. 5). The rearward portion of the grounding lead 40 projects slightly above the nominal diameter of the contact. During installation of the contact into the insert, the grounding lead 40 forces the contact assembly downward as it enters the hole 29 in the grounding plate, pushing the capacitor against the far side of the hole and compressing the resilient material. The compressible material in attempting to expand, maintains the electrical continuity between the grounding lead and the side of the grounding plate hole 29 and between the capacitor outer plating and the other side of the hole.

Figure 6:
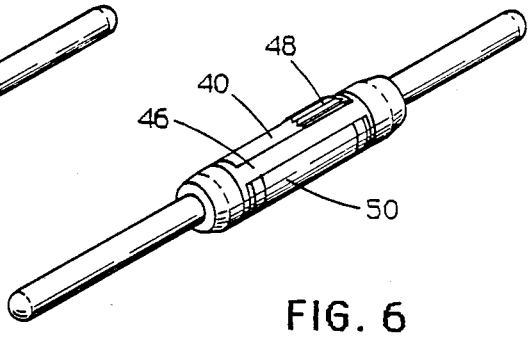
FIG. 6 is a perspective view of an alternate embodiment of the contact of the present invention shown in the assembled and encapsulated condition.

Another embodiment of the diode grounding lead is shown in FIG. 6. In this embodiment, the grounding lead 40 has raised knurls 48 on the portion of the grounding lead that would be aligned with the grounding plate 27. The knurls have a larger diameter over the splines than the diameter of the hole 29 in the grounding plate. There would be a light press fit between the contact assembly and the grounding plate hole 29 due to the knurls, resulting in electrical continuity between the diode grounding lead and the grounding plate and the plating on the outside of the capacitor and the grounding plate. The supporting pad, not shown in the FIG. 6, could be either made of a hard insulating material, or eliminated in lieu of the encapsulant 46 providing the needed support.

Transient suppression diode circuit characteristics such as impedence, capacitance, and current handling ability are all dependent on the active area of the diode. Given the nature of electromagnetic pulses or static discharge, it is prudent to design around current handling ability rather than a given power rating. For constant current handling requirements, as the breakdown voltage rating of a transient suppression diode increases, the power handling ability of the diode must increase. This dictates increasing the effective active surface area of the diode as the breakdown voltage rating is increased.

Instead of placing multiple diodes in parallel to handle the required current as suggested by prior art, it is better to place the diodes in series where each diode has a portion of the total breakdown voltage ration required. Series diodes may be of greatly different voltage ratings as long as each diode can carry the required current.

Figure 7:
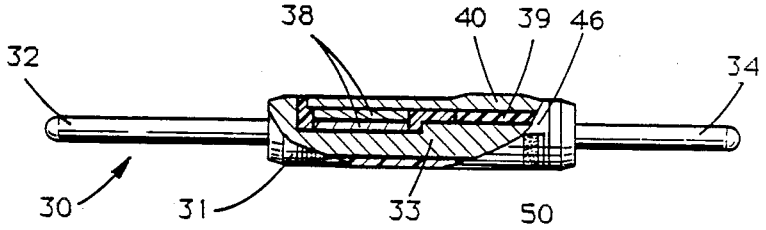
FIG. 7 is an enlarged partial sectional view of a stacked diode contact assembly for higher current handling capability.

As shown in FIG. 7, two or more transient suppression diodes 38 may be sandwiched directly together between the contact body midsection 33 and the grounding lead 40. Stacking the transient suppression diodes 38 increases the effective diode active area without increasing the mounting space requirements, reduces the capacitance (series capacitance) and increases the impedence between the diode and ground (series impedence).

EMI/RFI filtering is achieved through the capacitive filtering effect of the total capacitance of the transient suppression diode and that of the ceramic capacitor. In cases where the filtering effect is desired to be reduced, the contact mid-section could be encapsulated without the ceramic capacitor in the assembly. If the capacitance of the transient suppression diode 38 is desired to be further reduced, such as in the case of high frequency digital signals, low capacitance diodes may be placed in series with the transient suppression diode.

Figure 8:
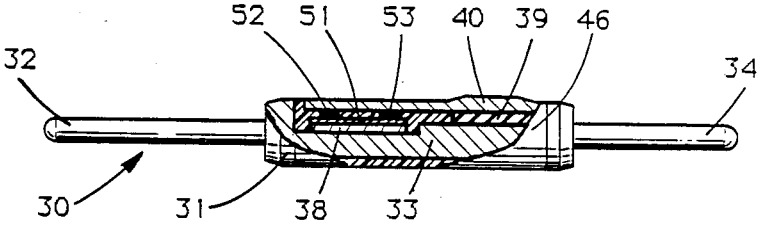
FIG. 8 is an enlarged partial sectional view of one embodiment of the low capacitance diodes stacked in series with the transient suppressing diode.

In the embodiment as shown in FIG. 8, the transient suppression diode 38 is mounted directly to the contact, a conductive plate 51 bonded to it, two low capacitance diodes 52 and 53 mounted to the conductive plate 51 with one low capacitance diode being in the opposite conduction direction from the other, and a grounding lead 40 mounted on top of them. No semi-tubular capacitor is mounted onto the contact as low capacitance is desired in this design. The entire assembly is encapsulated with a hermetic material 46. The conductive plate 51 serves to ensure even current distribution between the transient suppression diode 38 and the low capacitance diodes 52 and 53.

Figure 9:
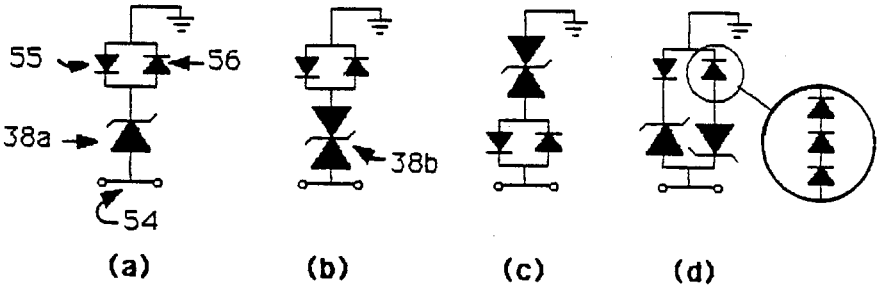
FIG. 9 shows several partial circuit schematics demonstrating a number of ways the low capacitance diodes may be placed functionally in series with transient suppressing diodes.

Several circuit configurations which demonstrate how the capacitance of the diode assembly may be reduced are shown in FIG. 9. The low capacitance diodes are represented by symbols 55 and 56, and the transient suppression diodes are represented by symbols 38*a* and 38*b*. The line 54 symbolizes the contact FIG. 9(*a*) and (*b*) are circuit schematics for the embodiment shown in FIG. 8 where 38*a* is a unipolar transient suppression diode and 38*b* is a bipolar transient suppression diode. It will be appreciated that multiple low capacitance diodes may be placed in series for each low capacitance diode shown in order to further reduce the capacitance as shown in FIG. 9(*d*). It will also be appreciated that there are other possible configurations which can accomplish the capacitance reductions that are extensions or variations of the configurations shown.

From the above description, it is apparent that the preferred embodiment achieves the objects of the present invention. Alternative embodiments and various modifications of the embodiments depicted will be apparent from the above description to those skilled in the art. These and other alternatives are considered to be equivalent and within the spirit of the present invention.

What is claimed is:

1. An electrical connector member comprising:

(a) an electrical connector shell;

(b) a grounding plate in said shell in electrical contact therewith;

(c) an opening extending through said grounding plate;

(d) a contact mounted in said opening;

(e) a transient suppression diode assembly mounted on one side of said contact whereby electrical circuits of which said contact is a part are protected from damaging electrical transients;

(f) a semi-tubular capacitor mounted on the other side of said contact, partially surrounding said contact, a longitudinal open section of said capacitor being oriented with and longitudinally overlapping said diode assembly whereby filtering and transient suppression functions can take place within the same longitudinal length along the contact thereby reducing the overall length of said contact and said connector;

(g) means for making electrical connection between said diode assembly and said grounding plate and between said semi-tubular capacitor and said grounding plate.

2. An electrical connector member as set forth in claim 1 wherein:

said means for making electrical connection includes a soft metallic diode grounding lead which is flat on the side attached to the diode and radiused transversely to the longitudinal axis of said contact on the other side and which engages said opening in said grounding plate.

3. The device as set forth in claim 2 wherein:

an end of said diode grounding lead opposite said diode assembly projects slightly above the nominal diameter of said contact, said end being supported by a compressible supporting pad, said compressible supporting pad causing said diode grounding lead and said semi-tubular capacitor to be maintained in electrical contact with said opening in said grounding plate when said supporting pad is compressed during and after assembly of said contact into said opening in said grounding plate.

4. The device as set forth in claim 2 wherein:

said end opposite said diode assembly of said diode grounding lead is formed or knurled to a diameter larger than said opening in said grounding plate and is supported thereunder by a hard supporting pad in order to obtain a light pressfit between said diode grounding lead and said opening in said grounding plate causing said diode grounding lead and said semi-tubular capacitor to be maintained in electrical contact with said opening in said grounding plate.

5. An electrical contact comprising:

(a) a conductive contact body having a forward mating end, a rear termination or mating end and a mid-section therebetween;

(b) a transient suppression diode assembly mounted on one side of said contact whereby electrical circuits of which said contact is a part are protected from damaging electrical transients;

(c) a semi-tubular capacitor mounted on the other side of said contact, partially surrounding said contact, a longitudinal open section of said capacitor being oriented with and longitudinally overlapping said diode assembly whereby filtering and transient suppression functions can take place within the same longitudinal length along the contact thereby reducing the overall length of said contact and a connector in which said contact may be mounted.

6. An electrical contact as set forth in claim 5 wherein:

said diode assembly is encapsulated by a hermetic encapsulating material whereby the diode assembly is protected from the environment and from stress concentrations at interfaces of said diode assembly.

7. An electrical contact as set forth in claim 5 including:

means for making electrical connection to said diode assembly.

8. An electrical contact as set forth in claim 7 wherein:

said means for making electrical connection includes a soft metallic diode grounding lead which is flat on the side attached to the diode and formed on the other side so as to optimize the electrical engagement with a grounding plate into which said contact may be assembled.

9. An electrical contact comprising:

(a) a conductive contact body having a forward mating end, a rear termination or mating end and a mid-section therebetween;

(b) a diode assembly mounted on one side of said contact;

(c) said diode assembly comprising multiple diodes, at least two of which are stacked in series.

10. An electrical contact as set forth in claim 9 wherein:

said diode assembly includes a least one transient suppression diode whereby electrical circuits of which said contact is a part are protected from damaging electrical transients.

11. An electrical contact as set forth in claim 9 including:

a semi-tubular capacitor mounted on the other side of said contact, partially surrounding said contact, a longitudinal open section of said capacitor being oriented with and longitudinally overlapping said diode assembly whereby filtering and transient suppression functions can take place within the same longitudinal length along the contact thereby reducing the overall length of said contact and a connector in which said contact may be mounted.

12. An electrical contact as set forth in claim 9 wherein:

said diode assembly comprises a single low capacitance diode or multiple low capacitance diodes connected in series with at least one transient suppression diode whereby the capacitance of said overall diode assembly may be reduced.

13. An electrical contact as set forth in claim 12 wherein:

said multiple low capacitance diodes are connected in parallel such that at least one of said low capacitance diodes is oriented in the opposite conduction direction from the balance of said low capacitance diodes.

14. An electrical contact as set forth in claim 9 wherein:

said diode assembly is encapsulated by a hermetic encapsulating material whereby the diode assembly is protected from the environment and from stress concentrations at interfaces of said diode assembly.

15. An electrical contact comprising:

(a) a conductive contact body having a forward mating end, a rear termination or mating end and a mid-section therebetween;

(b) a transient suppression diode assembly mounted on one side of said contact whereby electrical circuits of which said contact is a part are protected from damaging electrical transients;

(c) said diode assembly is encapsulated by a hermetic encapsulating material whereby the diode assembly is protected from the environment and from stress concentrations at interfaces of said diode assembly, wherein said contact is adapted to be mounted in an electrical device.

16. An electrical contact as set forth in claim 15 including:

means for making electrical connection to said diode assembly.

17. An electrical contact as set forth in claim 16 wherein:

said means for making electrical connection includes a soft metallic diode grounding lead which is flat on the side attached to the diode and formed on the other side so as to optimize the electrical engagement with a grounding plate into which said contact may be assembled.

* * * * *